US005373929A

United States Patent [19]

Chittleborough et al.

[11] Patent Number: 5,373,929

[45] Date of Patent: Dec. 20, 1994

[54] COIN VALIDATORS

[75] Inventors: Michael Chittleborough, Binfield; Alan M. G. Meeks, Chineham; Robert G. Lloyd, Tadley; Peter R. Johnson, Goring Heath, all of United Kingdom

[73] Assignee: Mars Incorporated, McLean, Va.

[21] Appl. No.: 104,053

[22] PCT Filed: Feb. 13, 1992

[86] PCT No.: PCT/GB92/00263

§ 371 Date: Sep. 24, 1993

§ 102(e) Date: Sep. 24, 1993

[87] PCT Pub. No.: WO92/15075

PCT Pub. Date: Sep. 3, 1992

[30] Foreign Application Priority Data

Feb. 13, 1991 [GB] United Kingdom ..... 9103063

[51] Int. Cl.[5] ..... G07F 3/02; G07F 1/04

[52] U.S. Cl. ..... 194/203

[58] Field of Search ..... 194/202, 203, 216, 217, 194/218, 219

[56] References Cited

U.S. PATENT DOCUMENTS

| | | | |
|---|---|---|---|
| 3,279,574 | 10/1966 | Seiden | 194/202 X |
| 3,279,575 | 10/1966 | Johnson | 194/203 |
| 4,298,116 | 11/1981 | Niemeyer . | |
| 4,881,630 | 11/1989 | Kobayashi et al. | 194/203 |
| 4,918,724 | 4/1990 | Vogl et al. | 194/203 X |
| 5,007,079 | 4/1991 | Vogl et al. | 194/203 X |
| 5,145,046 | 9/1992 | Satoh | 194/317 X |

FOREIGN PATENT DOCUMENTS

| | | | |
|---|---|---|---|
| 0070353 | 1/1983 | European Pat. Off. . | |
| 2628682 | 12/1977 | Germany . | |
| 3226737 | 1/1984 | Germany | 194/203 |
| 1168850 | 10/1969 | United Kingdom . | |
| 2224150 | 4/1990 | United Kingdom . | |
| 2250622 | 6/1992 | United Kingdom . | |

*Primary Examiner*—Michael S. Huppert
*Assistant Examiner*—Scott L. Lowe
*Attorney, Agent, or Firm*—Davis Hoxie Faithfull & Hapgood

[57] ABSTRACT

A coin validator is provided in the region of its entrance hopper with a flap which is caused to pivot against the action of a spring when a coin is inserted in the hopper. In the case of fraudulent use of the coin validator wherein a thread is attached to a coin, the movement of the flap into the closed position following passage of the coin causes a tension to be applied in the trailing thread, and the thread under tension is then sensed by a lever mechanism. Actuation of the lever mechanism by the tensioned thread inhibits validation of the attached coin, e.g. by causing any credit added by the passage of the coin past a testing station to be debited before returning the coin to the user.

23 Claims, 3 Drawing Sheets

COIN VALIDATORS

FIELD OF THE INVENTION

The present application relates to the prevention of fraud in coin validators.

BACKGROUND OF THE INVENTION

A well-known method of fraud associated with coin-operated machines involves attaching string or thread to a genuine coin and then inserting the coin into the machine while holding the string. Once the coin has passed the validating section and caused an appropriate amount of credit to be accumulated, the user is able to stop the coin from passing into a storage section by use of the string. He can then operate the machine to obtain goods or services, and then retrieve the coin, for example, by pressing an escrow return button.

U.K. Patent Application No. 2,250,622 in the name of the present applicant provides a solution to this problem, wherein the presence of a thread under tension or the presence of a thick thread is detected.

It would be desirable to provide another means of avoiding such fraud and one which does not depend on a user applying tension to the trailing thread.

SUMMARY OF THE INVENTION

According to one aspect of the present invention there is provided apparatus for preventing fraud in a coin validator wherein a thread is attached to a coin to be validated, comprising thread-detecting means arranged to be operated by a thread under tension, and means responsive to the operation of the thread-detecting means for inhibiting validation of the attached coin, characterised in that said apparatus further comprises means for gripping the thread so as to cause sufficient tension to operate the thread-detecting means irrespective of any tension applied thereto by a user.

The invention extends to coin validators incorporating such apparatus and to vending machines incorporating such coin validators.

The term "thread" is intended to embrace any elongate flexible material which could be attached to a coin for the above-mentioned type of fraud.

In a preferred embodiment the tension is applied to the thread by means of a flap which opens to allow a coin to pass but subsequently closes so as frictionally to engage any trailing thread, thereby applying tension. The flap is preferably caused to open by the weight of the coin itself, although it would be possible to provide a sensing arrangement upstream of the flap which senses the presence of a coin and causes the flap to open. The flap is conveniently biassed into its closed state by means of a counterweight and/or a spring. The flap is preferably arranged to pivot between its open and closed states, although an arrangement for causing the flap to slide in and out of the coin path would also be possible.

The thread, once tensioned, can be detected by a lever which is positioned so as to be actuated by the tensioned thread. Actuation of the lever can be sensed by optical or other means so as to generate a signal for inhibiting the coin validation. Such inhibition can be achieved by inhibiting the operation of the coin validator or by merely inhibiting an output of the coin validator or by deducting a credit value therefrom.

In accordance with a second aspect of the present invention there is provided a method of preventing fraud in a coin validator wherein a thread is attached to a coin to be validated, comprising:

detecting the presence of a thread under tension and thereby inhibiting validation of the attached coin, characterised in that the thread is automatically gripped so as to cause sufficient tension for the thread to be detected irrespective of any tension applied thereto by a user.

BRIEF DESCRIPTION OF THE DRAWINGS

Arrangements embodying the invention will now be described by way of example with reference to the accompanying drawings, in which.

DETAILED DESCRIPTION OF THE INVENTION

Figure 1:
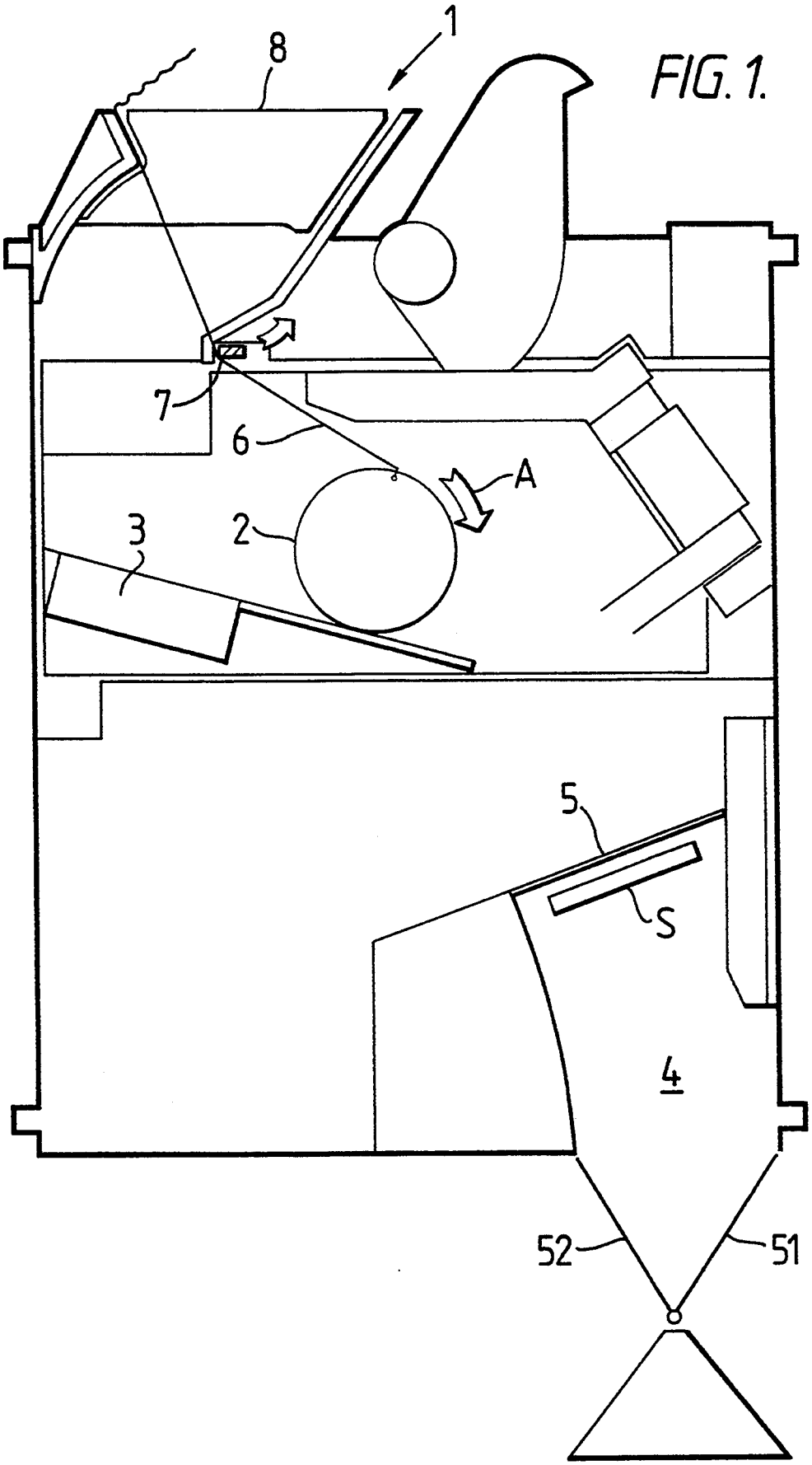
FIG. 1 is a schematic view of a coin mechanism incorporating apparatus in accordance with the present invention.

Referring to FIG. 1, a coin validator to which the present invention may be applied consists of an entrance hopper 1 into which a coin 2 may be inserted by a user. A coin thus inserted is allowed to fall under gravity onto an impact-absorbing member 3 and subsequently to roll down an inclined track in the sense indicated by the arrow A past a validating station (not shown). A coin deemed to be genuine is then caused to enter an escrow chamber 4 through an acceptance gate 5. Credit corresponding to the value of the coin is accumulated when a sensor S detects that the coin has moved past. The coin is stored in the chamber 4, and then as soon as a vend has taken place or a service been provided, the coin or coins in the escrow chamber are allowed by an escrow gate 51 to pass into one or more storage devices, such as a cash box, in the vending machine. If a customer decides he does not wish to make a purchase, he may operate an escrow return button which opens a return gate 52 to cause coins in the escrow chamber to be returned to him.

It is possible to defraud such coin validators by attaching one end of a length of thread 6 to a coin 2, as shown in the figure. By holding the other end of the thread, a user can cause the coin to be held in position after validation but before passing into a storage device. He is then able to retrieve the coin by operating the escrow return button. To overcome this problem a lever 7 is so positioned that the tension in the thread will cause it to be actuated, i.e. moved in the direction of the arrow in the figure. Such actuation is sensed and an actuation signal generated, which is then used to inhibit the operation of the coin validator or to inhibit the output of the coin validator or to deduct any credit that has accumulated in respect of that coin. Preferably, the circuit which accumulates credit in response to a trigger signal from the sensor S is inhibited by the operation of the lever 7. It would be possible for this circuit to be operable to accumulate credit after a predetermined short delay interval following the signal from the sensor S, unless by that time the lever 7 is operated. This prevents fraud even if there is a short delay between the coin passing the sensor S and the tension in the thread operating the lever 7.

With the provision of the lever mechanism alone, however, it is possible that the fraud could still operate if the thread is not under tension at a time when the lever actuation signal is monitored. In this case, the tension is subsequently applied by the user immediately after, for example, the user makes a vend selection and just before the escrow accept gate 51 opens, thereby preventing the coin from falling into the storage device. In order to prevent this method of fraud, a flap 8 is provided near the entrance hopper 1 for the purpose of causing any trailing thread in the validator to be under tension irrespective of whether the user applies any tension.

Figure 2:
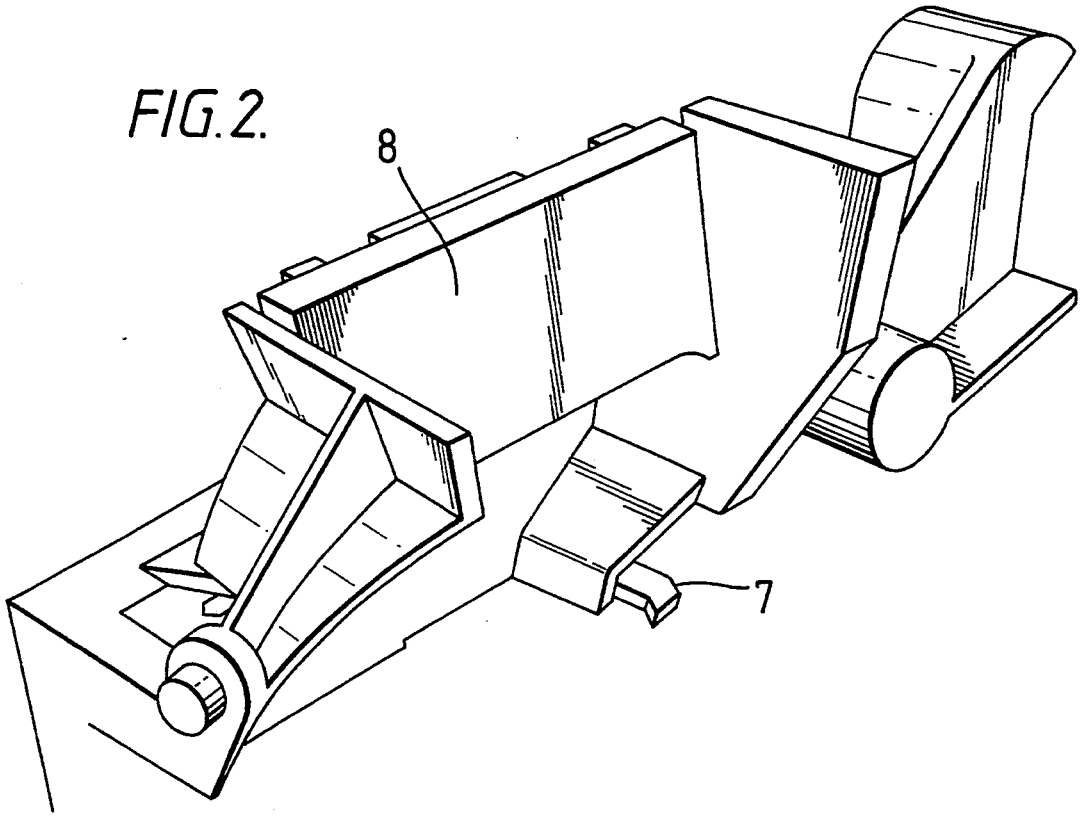
FIG. 2 is a perspective front view of a preferred embodiment of the present invention.
Figure 3:
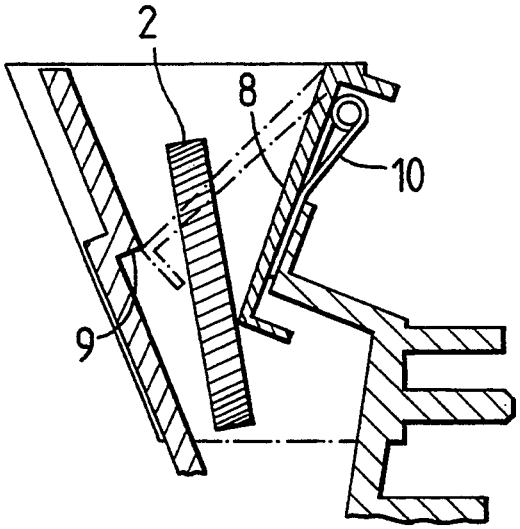
FIG. 3 is a cross-section showing the operation of the flap in the embodiment of FIG. 2.
Figure 4:
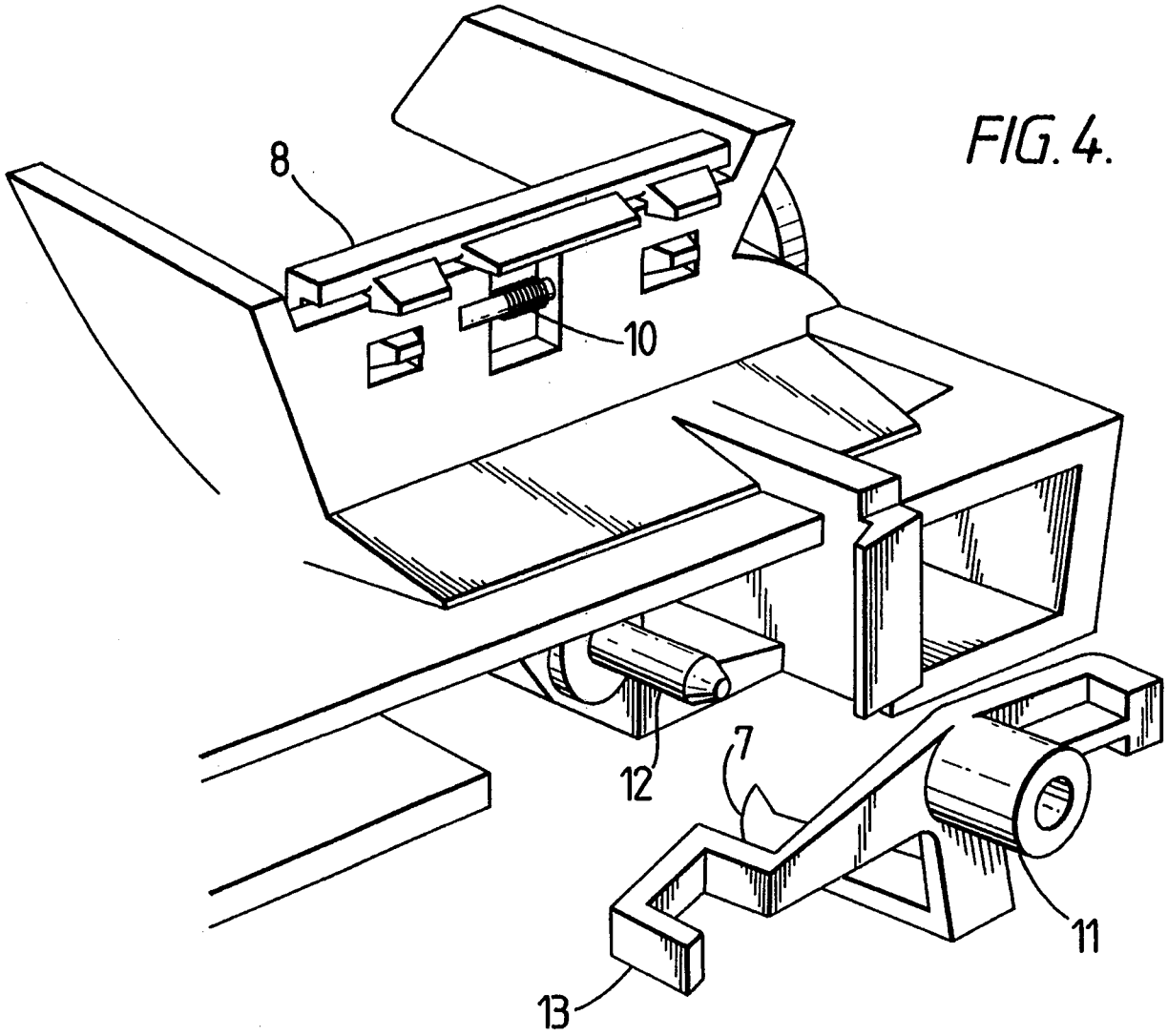
FIG. 4 is a perspective, exploded rear view of the embodiment of FIG. 2.

The flap 8 is shown in FIGS. 2, 3 and 4. It is arranged to pivot about an axis and in the absence of a coin, adopts a closed position as shown in chain-dotted lines in FIG. 3. The closed state is defined by abutment of the flap against a ridge 9 on one side of the entrance hopper. FIG. 3 indicates how the passage of a coin 2 causes the flap 8 to open. The weight of the coin 2 is sufficient to overcome a biassing provided by a coil spring 10. The spring is preferably strong enough to cause the flap to close after passage of a coin but not strong enough to prevent the lightest coin passing the flap. Also, for most or all of the coins, the spring should preferably not grip a trailing thread so tightly as to prevent the coin from passing through the validator. The function of the flap is solely to grip frictionally any trailing thread between itself and the ridge 9 so that the subsequent rolling of the coin down the inclined track will cause the thread to be under tension.

The tension applied to the thread causes actuation of the lever 7, as described above, and this lever mechanism is shown in more detail in FIG. 4.

The lever 7 constitutes an arm of a lever mechanism 11 which is arranged to pivot on a spigot 12 attached to the main body of the validator. The lever mechanism 11 is biassed into its normal, de-actuated state by a counterweight 13, although a spring may alternatively be used. The tension in the thread causes the lever mechanism 11 to pivot in a direction so as to oppose the biassing effect of the counterweight 13.

Upon actuation of the lever 7, a part of the lever mechanism is caused to pass either into or out of a path between a light source and photodetector (not shown) and the photodetector output is monitored to sense lever actuation.

Although the present invention has been described with reference to preferred embodiments, other possibilities of implementing the present invention will be envisaged by those skilled in the art. For example, although optical sensing of the lever actuation has been described, any movement transducer could be employed, such as a piezoelectric or capacitive transducer. Furthermore, although both the flap and the lever mechanism in the preferred embodiment exhibit pivotal movement, either or both could function with translational movement.

In addition, the apparatus may be provided with means for operating an alarm upon actuation of the lever 7 to draw attention to the attempted fraud.

Although the invention has been described with reference to preventing a method of fraud wherein a user is able to obtain a credit value for a coin which is subsequently returned by pressing an escrow return button, the invention can also serve to prevent a user from obtaining such credit value and subsequently retracting the thread to retrieve the coin from the entrance hopper, since the detection of the tensioned thread will serve to inhibit validation of the coin.

Furthermore, the invention can be applied to coin validators which do not include an escrow chamber. Again, provided the presence of tensioned thread is detected before a final validation output signal is generated, such signal can be inhibited by such detection (e.g. by preventing a credit amount from being accumulated, or by removing an accumulated credit), thereby preventing a user from obtaining value for that coin.

We claim:

1. Apparatus for preventing fraud in a coin validator wherein a thread is attached to a coin to be validated, comprising thread-detecting means arranged to be operated by a thread under tension, means responsive to the operation of the thread-detecting means for inhibiting validation of the attached coin, and means for gripping the thread so as to cause sufficient tension to operate the thread-detecting means irrespective of any tension applied thereto by a user.

2. Apparatus as claimed in claim 1, wherein the gripping means comprises a flap which is arranged to be opened by the passage of a coin and subsequently to close and thereby slidably engage any trailing thread so as to cause tension therein.

3. Apparatus as claimed in claim 2, wherein the flap is pivotable between positions defining its respective open and closed states.

4. Apparatus as claimed in claim 2, wherein the closed state of the flap is defined by a stop against which the flap abuts.

5. Apparatus as claimed in claim 2, further comprising means for biassing the flap into its closed state.

6. Apparatus as claimed in claim 5, wherein biassing means comprises a counterweight attached to the flap or integral therewith.

7. Apparatus as claimed in claim 5, wherein the biassing means comprises a spring.

8. Apparatus as claimed in claim 1, wherein the thread-detecting means comprises a lever which is positioned so as to be actuated by a tensioned thread.

9. Apparatus as claimed in claim 8, further comprising means for biassing the lever into its de-actuated state.

10. Apparatus as claimed in claim 8, wherein the thread-detecting means further comprises means for sensing actuation of the lever and for generating, in response thereto, a signal indicating the presence of the tensioned thread.

11. Apparatus as claimed in claim 10, wherein the sensing means comprises an optical sensor.

12. Apparatus as claimed in claim 10, further comprising means for inhibiting an output of the coin validator in response to the generation of said signal.

13. Apparatus as claimed in claim 10, further comprising means for deducting a credit value from an output of the coin validator in response to the generation of said signal.

14. Apparatus as claimed in claim 1, wherein said apparatus is connected to a coin validator.

15. Apparatus as claimed in claim 14, wherein the coin validator is connected to a vending machine.

16. A method of preventing fraud in a coin validator wherein a thread is attached to a coin to be validated, comprising:

detecting the presence of a thread under tension and thereby inhibiting validation of the attached coin, and automatically gripping the thread so as to cause sufficient tension for the thread to be detected irrespective of any tension applied thereto by a user.

17. A method as claimed in claim 16, wherein the step of automatically gripping the thread comprises opening a flap in response to passage of a coin and subsequently closing the flap and thereby slidably engaging any trailing thread so as to cause tension therein.

18. A method as claimed in claim 17, further comprising biassing the flap into its closed state.

19. A method as claimed in claim 16, wherein the step of detecting the presence of a thread under tension comprises causing the thread to actuate a lever.

20. A method as claimed in claim 19, further comprising biassing the lever into a de-actuated state.

21. A method as claimed in claim 19, further comprising sensing actuation of the lever and, in response thereto, generating a signal indicating the presence of a thread under tension.

22. A method as claimed in claim 21, further comprising inhibiting an output of the coin validator in response to the generation of said signal.

23. A method as claimed in claim 21, further comprising deducting a credit value from an output of the coin validator in response to the generation of said signal.

* * * * *